US009909834B1

(12) United States Patent
Wilhelm et al.

(10) Patent No.: US 9,909,834 B1
(45) Date of Patent: Mar. 6, 2018

(54) COLLAPSIBLE/INFLATABLE EXPLOSIVE DISRUPTOR

(71) Applicant: Department of the Navy, Indian Head, MD (US)

(72) Inventors: Christopher Wilhelm, Port Tobacco, MD (US); Angel Diaz, Indian Head, MD (US); Lee Foltz, Indian Head, MD (US); Daniel McCarthy, LaPlata, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/731,947

(22) Filed: Aug. 30, 2017

(51) Int. Cl.

| | |
|---|---|
| ***F41B 9/00*** | (2006.01) |
| ***F42B 3/00*** | (2006.01) |
| ***F42B 3/087*** | (2006.01) |
| ***F42D 5/04*** | (2006.01) |
| ***F42B 1/02*** | (2006.01) |

(52) U.S. Cl.
CPC ..... *F41B 9/0046* (2013.01); *F42B 1/02* (2013.01); *F42B 3/00* (2013.01); *F42B 3/087* (2013.01); *F42D 5/04* (2013.01)

(58) Field of Classification Search
CPC .... F42B 1/02; F42B 3/00; F42B 3/087; F42B 39/20; F42B 39/24; F41B 9/0031; F41B 9/0043; F41B 9/0046; F42D 5/04; F42D 5/045; F42D 5/05
USPC .... 86/50; 102/301, 305, 314, 322, 324, 331; 89/1.11, 1.1
See application file for complete search history.

(56) References Cited

U.S. PATENT DOCUMENTS

| | | | | |
|---|---|---|---|---|
| 4,151,798 | A * | 5/1979 | Ridgeway | F42B 3/08 102/307 |
| 4,543,872 | A * | 10/1985 | Graham | F42D 5/045 109/1 R |
| 4,836,079 | A * | 6/1989 | Barrett | F42D 5/045 102/303 |
| 5,864,767 | A | 1/1999 | Drumgoole et al. | |
| 6,439,120 | B1 * | 8/2002 | Bureaux | F42D 5/045 102/303 |
| 7,299,735 | B2 | 11/2007 | Alford | |
| 7,313,994 | B1 * | 1/2008 | Lacombe | F42D 5/045 102/303 |
| 7,819,063 | B1 | 10/2010 | Lehman | |
| 8,215,235 | B2 * | 7/2012 | Moore | F42D 3/00 102/305 |
| 8,267,013 | B2 | 9/2012 | Moore | |
| 8,677,902 | B1 | 3/2014 | Rock et al. | |

(Continued)

*Primary Examiner* — James S Bergin
(74) *Attorney, Agent, or Firm* — Frederic J. Zimmerman

(57) ABSTRACT

An explosive disruptor includes a first jacket having joined inflatable members. The inflatable members are adapted to be filled with a gas. A second jacket is surrounded by and coupled to the first jacket. The second jacket has an outer radial wall, an inner radial wall spaced apart from the outer radial wall, and two end walls coupled to opposing axial ends of the outer radial wall and the inner radial wall. A first volumetric region is defined between the outer radial wall, the inner radial wall, and the two end walls. A second volumetric region is defined by the inner radial wall. The first volumetric region is sealed and adapted to be filled with a liquid. An explosive material is disposed in the second volumetric region. A blasting cap is in contact with the explosive material.

19 Claims, 2 Drawing Sheets

(56) References Cited

U.S. PATENT DOCUMENTS

| | | | | |
|---|---|---|---|---|
| 9,322,624 | B2 | 4/2016 | Alford et al. | |
| 9,470,499 | B2 | 10/2016 | Benson | |
| 2008/0087185 | A1* | 4/2008 | James | F42D 5/045 102/303 |
| 2008/0098879 | A1* | 5/2008 | Parkes | F42B 33/06 86/50 |

* cited by examiner

COLLAPSIBLE/INFLATABLE EXPLOSIVE DISRUPTOR

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to explosive disruptors, and more particularly to an explosive disruptor that is partially collapsible and inflatable.

BACKGROUND OF THE INVENTION

Explosive disruptors are explosive devices that include a volume of water that forms a water jet upon detonation of the disruptor. In general, disruptors are made from rigid materials that are bulky to store and transport.

SUMMARY OF THE INVENTION

Accordingly, it is an object of the present invention to provide an explosive disruptor.

Another object of the present invention is to provide an explosive disruptor that is easy to store and transport.

Still another object of the present invention is to provide an explosive disruptor adaptable to a variety of configurations.

Other objects and advantages of the present invention will become more obvious hereinafter in the specification and drawings.

In accordance with the present invention, an explosive disruptor includes a first jacket having a plurality of inflatable members arranged at a radial periphery of the first jacket. Each inflatable member is disposed between two other inflatable members and joined thereto along a length of the first jacket. The inflatable members are adapted to be filled with a gas. A second jacket is surrounded by and is coupled to the first jacket. The second jacket has an outer radial wall, an inner radial wall spaced apart from the outer radial wall, and two end walls coupled to opposing axial ends of the outer radial wall and the inner radial wall. A first volumetric region is defined between the outer radial wall, the inner radial wall, and the two end walls. A second volumetric region is defined by the inner radial wall. The first volumetric region is sealed and is adapted to be filled with a liquid. An explosive material is disposed in the second volumetric region. A blasting cap is in contact with the explosive material.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
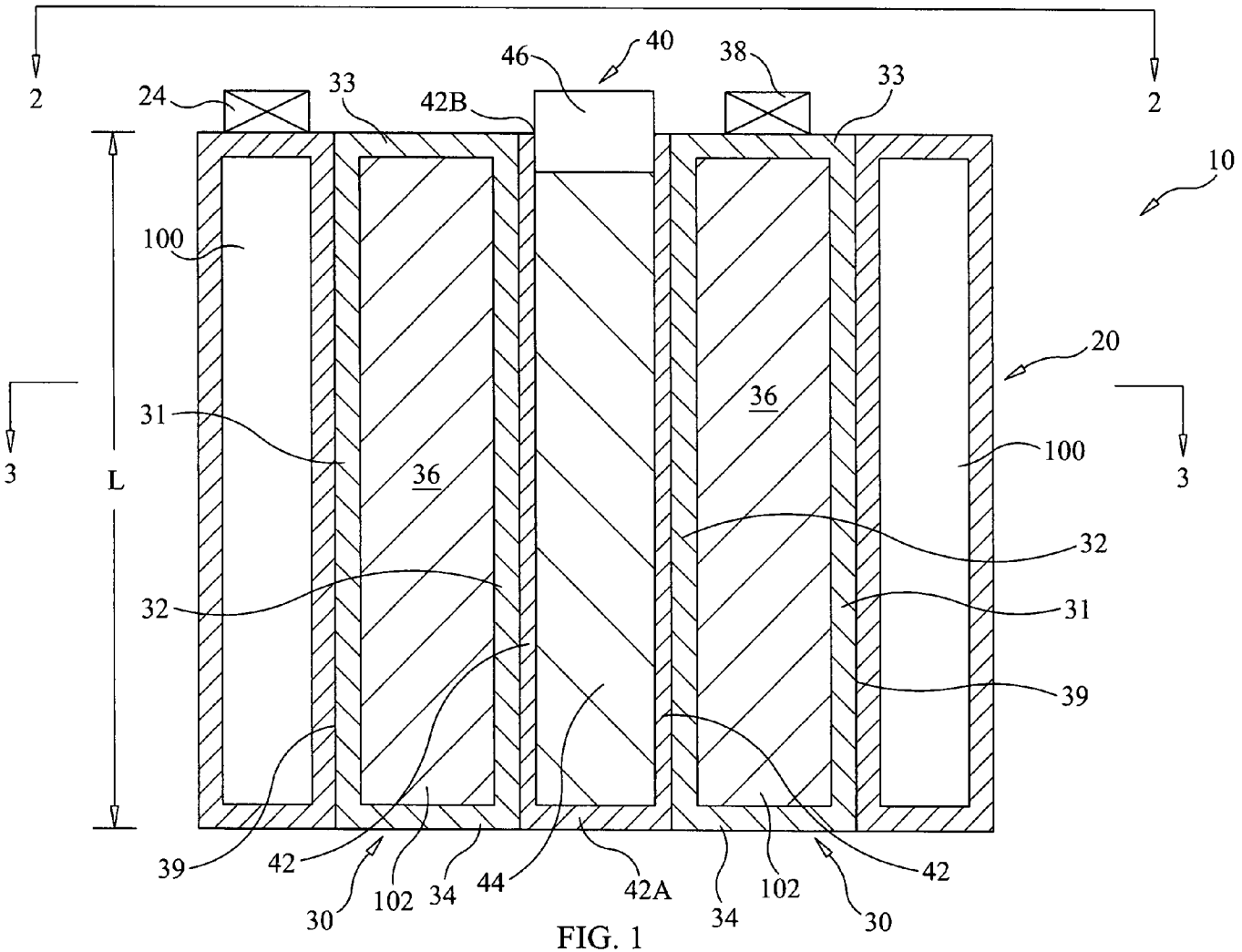
FIG. 1 is an axial cross-sectional view of a fully-inflated explosive disruptor in accordance with an embodiment of the present invention.
Figure 3:
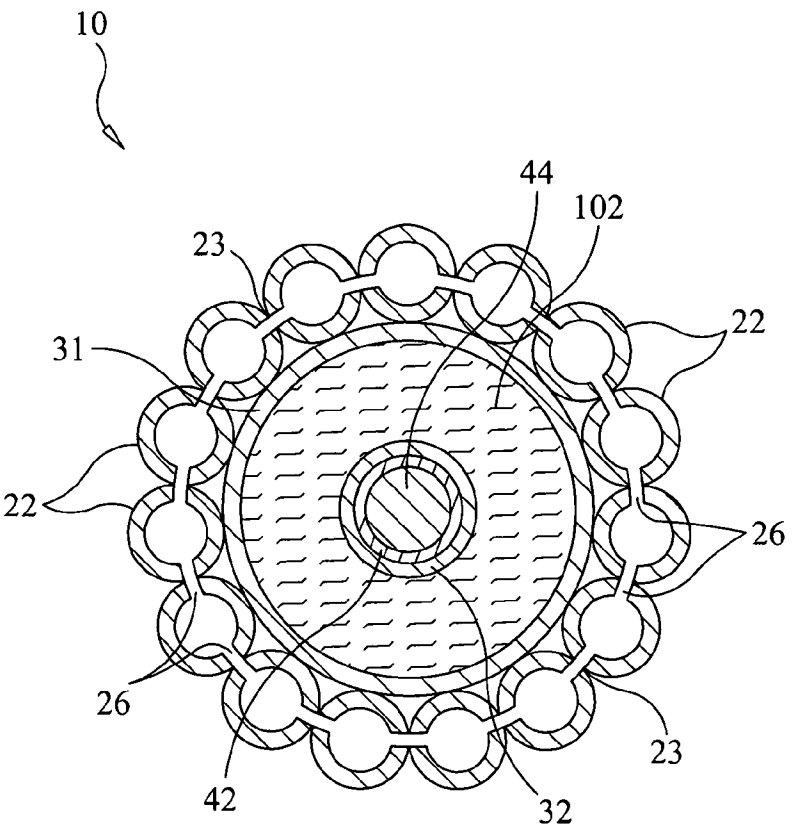
FIG. 3 is a radial cross-sectional view of the explosive disruptor taken along line 3-3 in FIG. 1.
Figure 2:
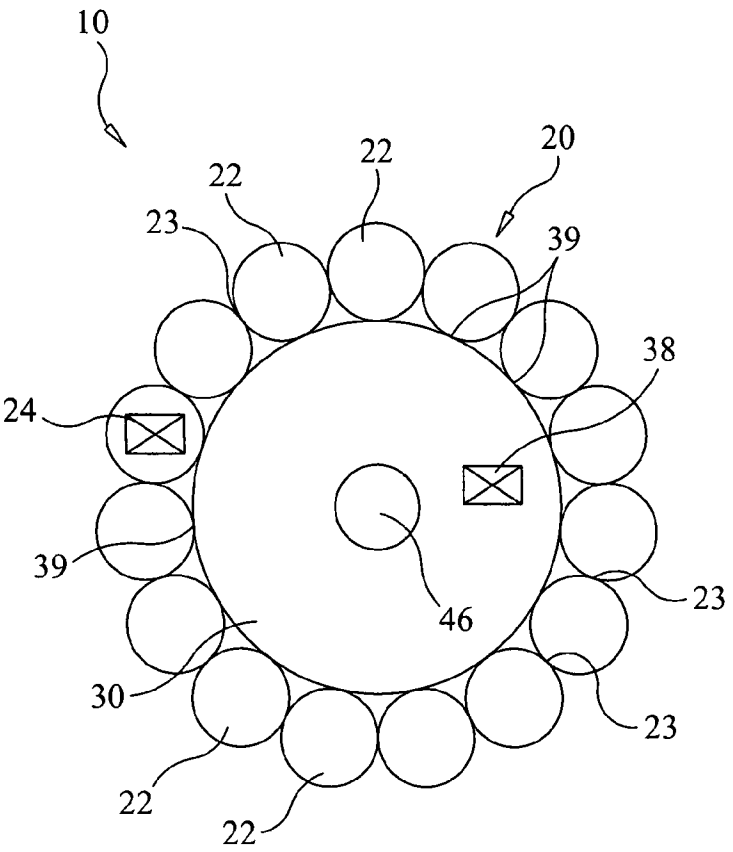
FIG. 2 is an end view of the explosive disruptor taken along line 2-2 in FIG. 1.

Referring now to the drawings, simultaneous reference will be made to FIGS. 1-3 where various views of an explosive disruptor in accordance with an exemplary embodiment of the present invention are shown and referenced generally by numeral 10. It is to be understood that explosive disruptor 10 is an exemplary configuration of the present invention and that numerous variations thereof will fall within the scope of the present invention. Explosive disruptor 10 is shown in its fully inflated state.

Explosive disruptor 10 includes collapsible and inflatable components that simplify storage and handling requirements while still allowing the disruptor to be quickly configured and deployed. Briefly, explosive disruptor 10 includes an outer jacket 20 inflated with a gas 100 (e.g., air), an inner jacket 30 surrounded by outer jacket 20 and inflated with a liquid 102 (e.g., water), and central explosive core 40 surrounded by inner jacket 30. Both outer jacket 20 and inner jacket 30 may be filled just prior to use. Explosive core 40 may be put in its place before or after the filling of jackets 20 and 30.

Outer jacket 20 is constructed from a plurality of inflatable members 22. In the illustrated embodiment, each of inflatable members 22 is a same-size cylinder sealed at each of its axial ends. However, the present invention is not limited to the use of cylindrical inflatable members as the inflatable members can be other geometric shapes without departing from the scope of the present invention.

Each inflatable member is disposed between and joined to the two adjacent inflatable members 22 located on the sides thereof as indicated by reference numeral 23. The joinder of adjacent inflatable members 22 takes place all along the length "L" of explosive disruptor 10. Inflatable members 22 are arranged at the radial periphery of a structure that, in the illustrated embodiment, is a circular cylinder. However, it is to be understood that other polygonal "cylindrical" structures may be defined by the joined inflatable members to include, for example, triangular cylinders, trapezoidal cylinders, hexagonal cylinders, octagonal cylinders, etc. Regardless of their individual shape/size or structural arrangement, inflatable members 22 are generally made from an air/gas impervious flexible material (e.g., plastics).

Outer jacket 20 is fillable through a valve 24, the type and position of which are not limitations of the present invention. To allow all of inflatable members 22 to be filled using a single valve 24, adjacent inflatable members 22 may be internally ported at 26 (FIG. 3) such that all internal regions of all inflatable members 22 are in fluid communication with one another.

Inner jacket 30 is a tubular jacket defined by an outer radial wall 31, an inner radial wall 32 spaced a radial distance away from outer radial wall 31, and axial end walls 33 and 34 sealed to each of radial walls 31 and 32. The resulting single volumetric region 36 is fillable with liquid 102 (e.g., water) through a valve 38, the type and position of which are not limitations of the present invention. The walls of inner jacket are made from a flexible, liquid-impervious material such as plastics. Each inflatable member 22 can be coupled to outer radial wall 31 all along the length L of explosive disruptor 10 as indicated by numeral 39.

A volumetric region located radially inward of inner radial wall 32 holds explosive core 40. In the illustrated embodiment, explosive core 40 includes a rigid tube 42 sealed at one axial end 42A thereof, an explosive material 44 filling tube 42, and a blasting cap 46 disposed at an opposing axial end 42B of tube 42 and in contact with explosive material 44. The choices for explosive material 44 and blasting cap 46 are not limitations of the present invention. Tube 42 is generally sized and shaped to form a sliding fit within the volumetric region defined radially inward of inner radial wall 32. Tube 42 can have the same length L as explosive disruptor 10.

The advantages of the present invention are numerous. The explosive disruptor may be stored and transported in a completely deflated condition and filled with an appropriate and available gas and liquid just prior to use. The explosive core may be disposed in the disruptor prior to or after the filling of the disruptor's inner and outer jackets.

Although the invention has been described relative to a specific embodiment thereof, there are numerous variations and modifications that will be readily apparent to those skilled in the art in light of the above teachings. For example, the overall geometry of the explosive disruptor can be adapted to provide an omnidirectional water jet (as would be the case with the illustrated embodiment) or a focused water jet without departing from the scope of the present invention. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. An explosive disruptor, comprising:

a first jacket including a plurality of inflatable members arranged at a radial periphery thereof, each of said inflatable members disposed between two others of said inflatable members and joined to each of said two others along a length of said first jacket, said inflatable members adapted to be filled with a gas;

a second jacket being surrounded by and being coupled to said first jacket, said second jacket includes an outer radial wall, an inner radial wall spaced apart from said outer radial wall, and two end walls coupled to opposing axial ends of said outer radial wall and said inner radial wall, wherein a first volumetric region is defined between said outer radial wall, said inner radial wall, and said two end walls, and wherein a second volumetric region is defined by said inner radial wall, said first volumetric region being sealed, said first volumetric region adapted to be filled with a liquid;

an explosive material being disposed in said second volumetric region; and a blasting cap in contact with said explosive material.

2. The explosive disruptor as in claim 1, wherein said first jacket is cylindrical.

3. The explosive disruptor as in claim 1, wherein walls of said inflatable members comprise a flexible material.

4. The explosive disruptor as in claim 1, wherein said outer radial wall, said inner radial wall, and said two ends walls comprise a flexible material.

5. The explosive disruptor as in claim 1, wherein internal regions of said inflatable members are in fluid communication with one another.

6. The explosive disruptor as in claim 1, wherein each of said inflatable members is coupled to said outer radial wall of said second jacket.

7. The explosive disruptor as in claim 1, wherein a length of said second jacket is equal to said length of said first jacket.

8. The explosive material as in claim 1, further comprising a rigid tube being disposed in said second volumetric region for housing said explosive material.

9. An explosive disruptor, comprising:

a first tubular jacket including a plurality of inflatable members being arranged at a radial periphery thereof, each of said inflatable members disposed between two others of said inflatable members and joined to each of said two others along a length of said first tubular jacket, each of said inflatable members include flexible walls, said inflatable members adapted to be filled with a gas;

a second tubular jacket being surrounded by and coupled to said first tubular jacket, said second tubular jacket includes a flexible outer radial wall, a flexible inner radial wall spaced apart from said outer radial wall, and two end walls coupled to opposing axial ends of said outer radial wall and said inner radial wall, wherein a first volumetric region is defined between said outer radial wall, said inner radial wall, and said two end walls, and wherein a second volumetric region is defined by said inner radial wall, said first volumetric region being sealed, said first volumetric region adapted to be filled with a liquid;

an explosive material being disposed in said second volumetric region; and a blasting cap being in contact with said explosive material.

10. The explosive disruptor as in claim 9, wherein said first tubular jacket is cylindrical.

11. The explosive disruptor as in claim 9, wherein internal regions of said inflatable members are in fluid communication with one another.

12. The explosive disruptor as in claim 9, wherein each of said inflatable members is coupled to said outer radial wall of said second tubular jacket.

13. The explosive disruptor as in claim 9, wherein a length of said second tubular jacket is equal to said length of said first tubular jacket.

14. The explosive material as in claim 9, further comprising a rigid tube being disposed in said second volumetric region for housing said explosive material.

15. An explosive disruptor, comprising:

a first jacket including a plurality of inflatable members arranged at a radial periphery thereof, each of said inflatable members disposed between two others of said inflatable members and joined to each of said two others along a length of said first jacket, said inflatable members adapted to be filled with a gas;

a second jacket being surrounded by and coupled to said first jacket, said second jacket includes a flexible outer radial wall, a flexible inner radial wall spaced apart from said outer radial wall, and two end walls coupled to opposing axial ends of said outer radial wall and said inner radial wall, wherein a first volumetric region is defined between said outer radial wall, said inner radial wall, and said two end walls, and wherein a second volumetric region is defined by said inner radial wall, said first volumetric region being sealed, said first volumetric region adapted to be filled with a liquid;

a rigid tube being disposed in said second volumetric region, said rigid tube includes a first axial end and a second axial end, said first axial end is sealed;

an explosive material filling said rigid tube; and a blasting cap being disposed in said second axial end of said rigid tube and in contact with said explosive material.

16. The explosive disruptor as in claim 15, wherein said first jacket is cylindrical.

17. The explosive disruptor as in claim 15, wherein internal regions of said inflatable members are in fluid communication with one another.

18. The explosive disruptor as in claim 15, wherein each of said inflatable members is coupled to said outer radial wall of said second jacket.

19. The explosive disruptor as in claim 15, wherein a length of said second jacket is equal to said length of said first jacket, and wherein a length of said rigid tube is equal to said length of said first jacket.

* * * * *